United States Patent [19]

Weingardt

[11] 4,228,916

[45] Oct. 21, 1980

[54] PLASTIC PAINT BUCKET WITH METAL SEALING RING

[75] Inventor: Rolf E. Weingardt, Scarsdale, N.Y.

[73] Assignee: Standard Container Company, Montclair, N.J.

[21] Appl. No.: 926,542

[22] Filed: Jul. 20, 1978

[51] Int. Cl.[3] ..... B65D 43/06

[52] U.S. Cl. ..... 220/354; 220/307; 220/DIG. 14; 220/DIG. 25; 220/73

[58] Field of Search ..... 220/352–358, 220/309, 307, 306, 308, 72, 73, DIG. 11, DIG. 14, DIG. 25; 206/509, 515

[56] References Cited

U.S. PATENT DOCUMENTS

| | | | |
|---|---|---|---|
| 2,606,085 | 8/1952 | Erb | 220/354 |
| 2,885,108 | 5/1959 | Donoghue | 220/354 |
| 2,905,357 | 9/1959 | Riener | 220/354 |
| 3,035,623 | 5/1962 | Goetz | 180/48 |
| 3,142,433 | 7/1964 | Balocca | 220/355 X |
| 3,380,616 | 4/1968 | Schoeller | 206/509 |
| 3,730,382 | 5/1973 | Heisler | 220/354 |
| 3,851,792 | 12/1974 | Ankney | 206/459 |
| 3,913,785 | 10/1975 | Pattershall | 220/354 |
| 3,944,115 | 3/1976 | Moonan et al. | 220/355 |
| 4,004,710 | 1/1977 | Crisci | 220/355 X |
| 4,027,778 | 1/1977 | Tupper | 220/355 |

FOREIGN PATENT DOCUMENTS

| | | | |
|---|---|---|---|
| 1297050 | 11/1972 | United Kingdom | 206/509 |

*Primary Examiner*—Joseph Man-Fu Moy
*Attorney, Agent, or Firm*—Brumbaugh, Graves, Donohue & Raymond

[57] ABSTRACT

A plastic paint bucket has a double-tight metal sealing ring which is crimped to the top rim of the bucket.

18 Claims, 5 Drawing Figures

PLASTIC PAINT BUCKET WITH METAL SEALING RING

FIELD OF THE INVENTION

This invention relates to plastic paint buckets, and, more particularly, to plastic paint buckets having a metal double-tight sealing ring for receiving a conventional resealable double-tight lid.

BACKGROUND OF THE INVENTION

There are two known types of plastic paint cans. One type is designed for use with plastic snap-on lids. The other type employs a metal lid with deformable tabs which can be bent to grip a portion of the can. The metal lid is removed by unbending the tabs so that they no longer grip the can.

The plastic paint cans with plastic lids are disadvantageous because the plastic lids can be punctured or ruptured more easily than their metal counterparts. The metal lids with tabs suffer from a relatively short life expectancy because the tabs become permanently deformed or break off when they are bent repeatedly to open and reseal the can.

Because of such deficiencies in the known plastic paint cans, the paint can most widely used at the present is a cylindrical metal container provided with a double-tight metal sealing ring attached to the top rim of the can. The primary advantage of this old design, which best accounts for its enduring popularity, is that the double-tight sealing ring affords an excellent seal which can be opened and resealed repeatedly, without encountering any of the problems discussed above.

Heretofore, nobody has developed a plastic paint can having a double-tight metal sealing ring. One reason for the lack of such a development in the past is that very few container manufacturers have the expertise in the plastic and metal technologies necessary to produce the plastic can and the double-tight metal sealing ring. Also, the manufacturing companies possessing the sophisticated metal technology required to make the metal sealing rings would rather market a product manufactured entirely of metal, so that they could provide the metal can as well as the metal sealing rings. For a similar reason, manufacturers of plastic paint cans prefer to produce an all plastic product.

Notwithstanding the popularity of the metal paint cans with double-tight metal sealing rings and their extensive use in the paint industry, these cans do suffer from some rather significant disadvantages. What follows is a brief discussion of three of the more prevalent and serious disadvantages.

First, the conventional double-tight cylindrical metal can is expensive to produce because of the cost involved in purchasing the sheet metal from which the can is fabricated and in coating the can to prevent rust. Storage and transportation of the cans are complicated due to their weight and shape, which prevents them from nesting one inside another.

A rust preventer is applied to the sheet metal used to make the double-tight sealing ring, but cutting of the sheet metal to form a ring blank from which the sealing ring is formed leaves a raw uncoated inner end of metal which can become rusty. Thus, a second problem is that the paint can be discolored by rust which forms on the inner edge of the sealing ring and falls into the paint. Numerous elaborate efforts have been made to prevent the inner edge of the sealing ring from rusting. These efforts, for the most part, have been ineffective or expensive, so that the problem persists to this day.

A third problem is that the underside of the double-tight sealing ring tends to collect paint which then dries and, over a period of time, becomes brittle. Then, when the can is reopened, the dry brittle paint on the underside of the sealing ring will sometimes break apart and fall into the paint, making it necessary to strain the paint before using it.

SUMMARY OF THE INVENTION

In accordance with the present invention, there is provided a new and improved paint can which normally includes a bucket open at one end and a double-tight metal sealing ring attached to the open end of the bucket. In accordance with one embodiment of the invention, the improvement involves making the bucket from a plastic material. The plastic bucket is lighter than a comparably sized metal can, making the plastic bucket easier to handle, store and transport. Storage and transportation of the plastic bucket can be further facilitated by tapering the sidewall of the bucket from its open end to its closed end, so that empty buckets can be nested one within another. By making the bucket from a plastic material, it is rendered virtually lead free.

The metal sealing ring may be supported solely by the upper rim of the plastic bucket. Alternatively, it is possible to support the sealing ring using opposite sidewalls of a channel running alongside the upper rim of the bucket and having one of its sidewalls formed thereby. Because one sidewall of the channel supports the inner edge of the sealing ring while the other sidewall supports the outer edge of the sealing ring, the inner end of the sealing ring can be protected from rusting by embedding it in one of the sidewalls of the channel. When the outer sidewall of the channel is formed by the upper rim of the bucket, the bottom of the channel slopes downwardly at a steep enough angle to inhibit the collection of paint thereon.

BRIEF DESCRIPTION OF THE DRAWINGS

For a better understanding of the invention, reference may be had to the following detailed description of three exemplary embodiments, taken in conjunction with the figures of the accompanying drawings, in which.

DESCRIPTION OF THE EXEMPLARY EMBODIMENTS

Figure 1:
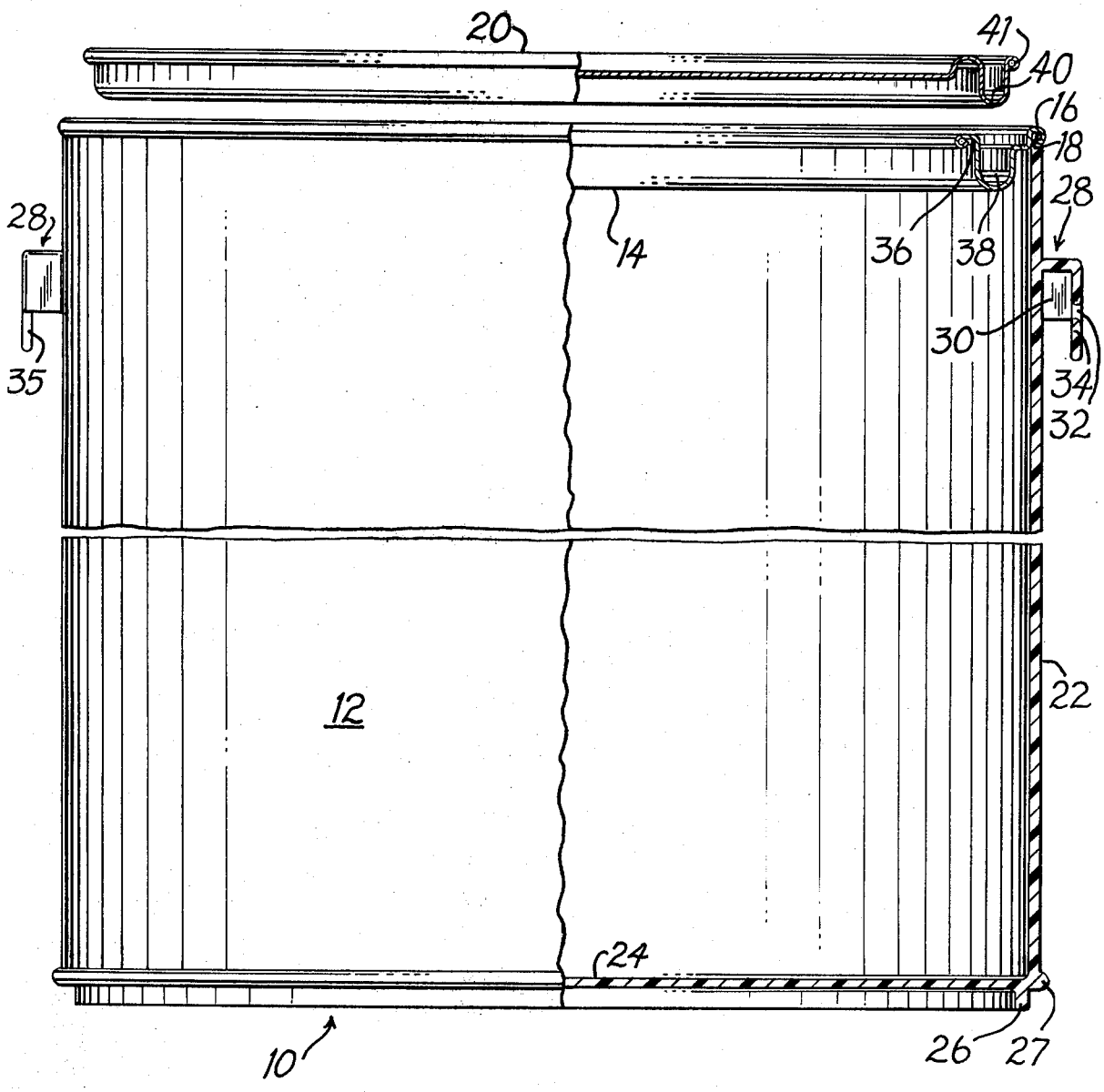
FIG. 1 is an elevational view, partially cut away, of one embodiment of a paint bucket constructed in accordance with the present invention, a lid being shown above the bucket.

Referring to FIG. 1, there is shown a paint can 10 including a cylindrical plastic bucket 12 and a double-tight metal sealing ring 14, an outer circumferential edge 16 of which is crimped to an upper rim 18 of the bucket 12. A lid 20 is designed, as discussed in greater detail below, to releasably mate with the sealing ring 14 so as to form an air-tight seal for the opening defined by the sealing ring 14.

The bucket 12, which can be made from any suitable plastic material, such as polypropylene or a high density polyethylene, by any suitable conventional molding process, has a straight substantially vertical sidewall 22 and a bottom wall 24 formed monolithically therewith. The bottom wall 24, which can have reinforcing ribs (not shown) formed therein, is spaced slightly above a lower rim 26 of the bucket 12, so that the bucket 12 rests on the lower rim 26, rather than on the bottom wall 24, to provide a stable footing for the bucket 12 and prevent damage to the bottom wall 24. The outer diameter of the lower rim 26 is slightly less than the outer diameter of the sidewall 22, the difference in the diameters being selected so as to permit the lower rim 26 to rest in an annular groove formed between the outer circumferential edge 16 of the sealing ring 14 and an outer curl 41 on the lid 20, whereby the bucket 12 can be stacked on top of another such plastic bucket or a conventional metal paint can with a double-tight sealing ring.

Because the sidewall 22 is straight, the outside dimensions of the bucket 12 can be substantially identical to those of conventional metal paint cans. In order to completely assimilate conventional metal paint cans, the bucket 12 has an annular bead 27 which is formed on the lowermost extremity of the sidewall 22 with an outer diameter that matches the outer diameter of the metal sealing ring 14. The bucket 12 is thus compatible with existing filling and handling equipment and can be substituted for the conventional metal can without the need to invest in new filling and handling equipment.

A pair of ears 28 is formed monolithically with the sidewall 22, each ear 28 being located on a portion of the sidewall 22 diametrically opposite the other ear 28. Each of the ears 28 has an inverted U-shaped vertical cross section in a plane substantially parallel to a plane which is tangent to a portion of the sidewall 22 adjacent to a corresponding one of the ears 28. A hole 32 extends through an outer face 34 of the ears 28 and communicates with a cavity 30 formed in each one of the ears 28. Depending upon the design of the ear 28, the hole 32 can be round or elliptical, but its lateral dimension must be large enough to receive one end of a wire bail (not shown) for the bucket 12. The outer face 34 of each of the ears 28 has a downwardly projecting and tapering apron 35 which is designed to provide gauging surfaces for an automatic bail-inserting machine.

The outer circumferential edge 16 of the sealing ring 14 is curled around the upper rim 18 of the bucket 12 and embeded in the sidewall 22, with the inner circumferential edge 36 of the sealing ring 14 projecting radially inwardly from the sidewall 22 of the bucket 12. An upwardly opening annular trough 38, having a generally U-shaped vertical cross section, is formed in the sealing ring 14. The trough 38 receives an annular sealing rib 40 formed on the lid 20 and having a generally U-shaped vertical cross section. The trough 38 and the sealing rib 40 are designed in a conventional manner to form a double-tight seal.

Figure 2:
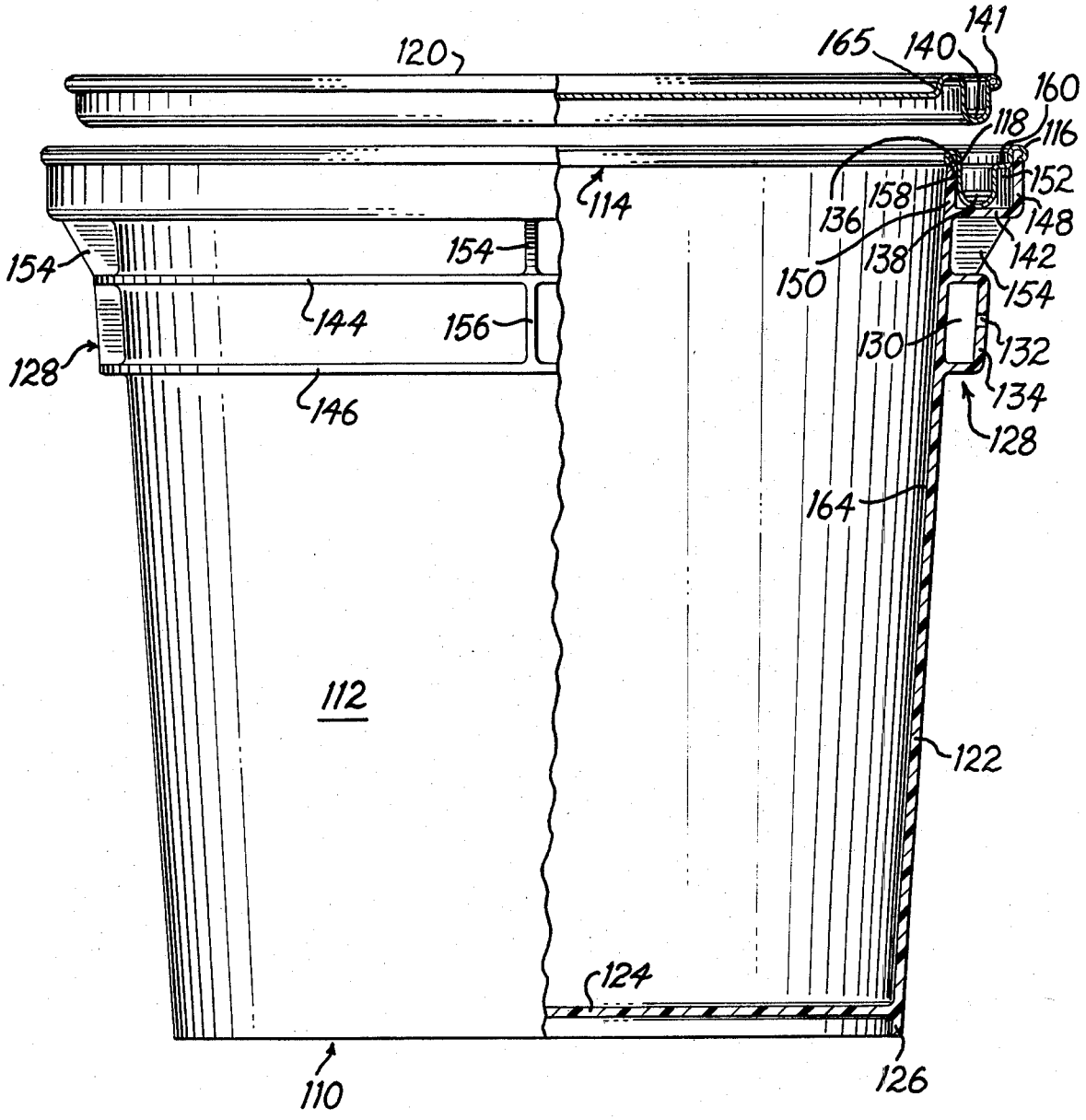
FIG. 2 is an elevational view, partially cut away, of a second embodiment of a paint bucket constructed in accordance with the invention, a lid again being shown above the bucket.
Figure 3:
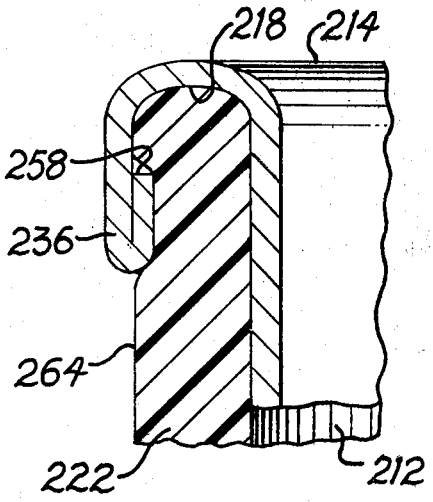
FIG. 3 is a partial cross-sectional view of the upper rim of the paint bucket illustrated in FIG. 3 showing an alternative technique for attaching the inner circumferential edge of a metal sealing ring thereto.
Figure 4:
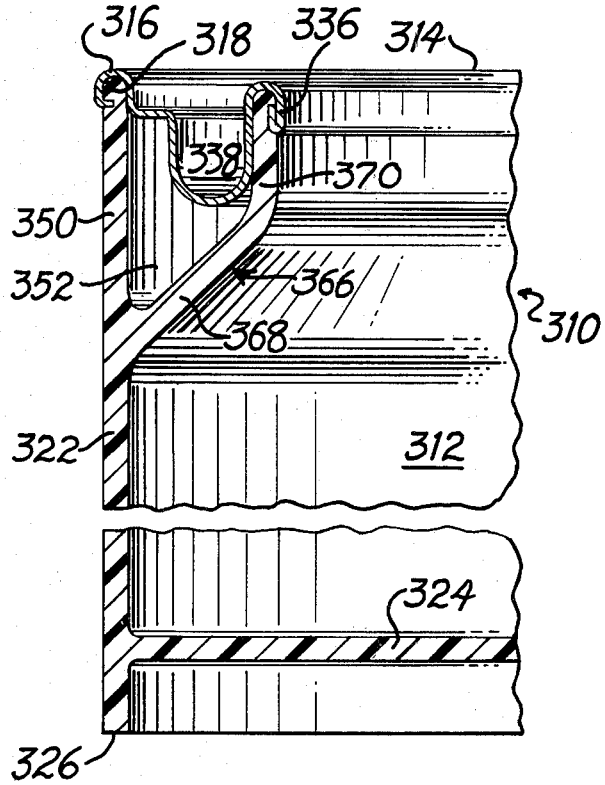
FIG. 4 is a partial cross-sectional view of a third embodiment of a paint bucket constructed in accordance with the present invention.

Referring to FIGS. 2–4, there are shown other embodiments of the present invention. The various elements illustrated in FIGS. 2–4 which correspond to elements described above with respect to FIG. 1 have been designated by corresponding reference numerals increased by 100, 200 and 300, respectively.

Figure 2A:
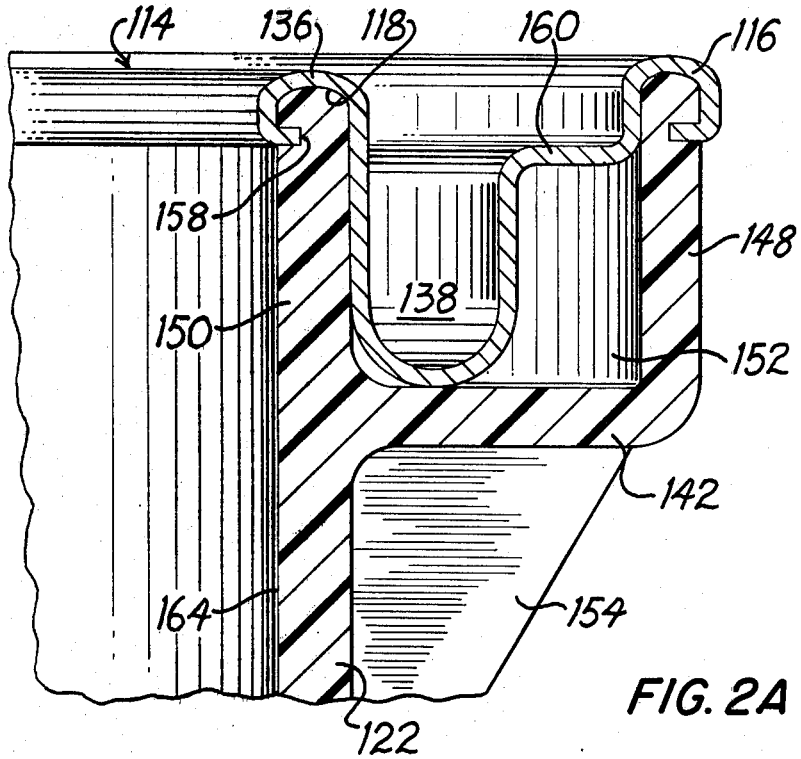
FIG. 2A is a cross-sectional view showing, in greater detail, the upper rim of the paint bucket illustrated in FIG. 2.

In the embodiments shown in FIGS. 2 and 2A, a paint can 110 includes a plastic bucket 112 having a round downwardly tapering sidewall 122 and a bottom wall 124, which is constructed like the bottom wall 24 of the bucket 12 shown in FIG. 1, so that the bucket 112 rests on a lower rim 126 rather than on the bottom wall 124. By keeping the taper of the sidewall 122 to a minimum, the bucket 112 can be made so that it is compatible for use with existing filling and handling equipment.

Along the upper region of the bucket 112, a series of vertically-spaced horizontal ribs 142, 144 and 146 are formed monolithically with the sidewall 122. The ribs 142, 144 and 146 strengthen the upper portion of the bucket 112 to better enable the bucket 112 to hold its round horizontal cross-sectional shape when a lid 120 has been removed.

A pair of ears 128 is formed monolithically with the sidewall 122 between the ribs 144 and 146, each ear 128 being located on a portion of the sidewall 122 diametrically opposite the other ear 128. The ears 128 are similar to the ears of conventional metal paint cans, but nevertheless, like the ears 28 of the bucket 12 shown in FIG. 1, include a cavity 130, hole 132 and outer face 134.

An upright wall 148 is formed monolithically with the rib 142, the upright wall 148 and the rib 142 forming with an upper band 150 of the sidewall 122 an annular upwardly opening U-shaped channel 152. A plurality of struts 154, which are spaced in increments of 90° around the circumference of the bucket 112, extend vertically between the ribs 142 and 144 to support the channel 152. Similar vertical struts 156 extend between the ribs 144 and 146 diametrically opposite portions of the bucket 112 approximately midway between the ears 128 and generally below two of the struts 154.

An annular metal sealing ring 114, similar to the one shown in FIG. 1, is disposed in the channel 150 and supported at its inner circumferential edge 136 and its outer circumferential edge 116 by an upper rim 118 of the bucket 112 and the upright wall 148, respectively. The inner circumferential edge 136 of the sealing ring 114 is curled around the upper rim 118 of the bucket 112 and embedded in the sidewall 122, so that an inner circumferential end 158 of the sealing ring 114 is covered and protected from contact with the liquid contents of the bucket 112 or the moisture laden air above the liquid level. This protects the inner circumferential end 158 from rusting and also prevents any rust that should form thereon from bleeding down inside the bucket 112 into its contents. The outer circumferential edge 116 of the sealing ring 114 is attached in a similar manner to the upright wall 148.

The sealing ring 114 includes an annular trough 138, which is designed to releasably receive an annular sealing rib 140 formed on a lid 120, and a landing 160 located horizontally between the trough 138 and the outer circumferential edge 116 of the sealing ring 114. The vertical elevation of the landing 160 is slightly lower than the upper rim 118 of the bucket 112, so as to form an annular depression into which a curl 141 on an outer circumferential edge of the lid 120 is received.

The width of the landing 160 is greater than the diameter of the curl 141, so that the tip of a screwdriver can be inserted underneath the curl 141 to pry the lid 120 off of the sealing ring 114 using the outer circumferential edge 116 of the sealing ring 114 as a fulcrum for the screwdriver. The struts 154 and 156 support the upright wall 148 to give greater rigidity to the outer circumferential edge 116 of the sealing ring 114 during its use as a fulcrum when the lid 120 is being removed. An annular shoulder 165 is formed on the lid 120 to provide a seat for receiving the lower rim 126 of another such bucket so that the buckets can be stacked one on top of another.

Because the sealing ring 114 does not extend radially inwardly beyond an inner circumferential surface 164 of the sidewall 122, paint cannot collect and dry underneath the sealing ring 114. Instead, any paint which might accumulate on the inner circumferential surface 164 of the sidewall 122 in the vicinity of the upper rim 118, such as when a wet brush is wiped against the upper rim 118 to remove excess paint, runs straight down the inner circumferential surface 164.

An alternate configuration for hiding an inner circumferential end 258 of a sealing ring 214 is shown in FIG. 3. In this embodiment, the inner circumferential edge 236 of the sealing ring 214 is J-shaped and crimped against an inner circumferential surface 264 of a sidewall 222 of a plastic bucket 212 to form a fluid-tight seal between the sidewall 222 of the bucket 212 and the inner circumferential edge 236 of the sealing ring 214. Inasmuch as the inner circumferential end 258 of the sealing ring 214 is effectively protected against contact with the liquid contents of the bucket 212 and the moist air in the bucket 212, this embodiment also inhibits rust from forming on the inner circumferential end 258 of the sealing ring 214 and prevents any rust that might form from bleeding into the contents of the bucket 212.

In FIG. 4, there is shown a paint can 310 including a straight-sided plastic bucket 312 having a generally round sidewall 322 and a bottom wall 324 formed monolithically therewith. An annular lip 366 is formed monolithically with the sidewall 322 and projects radially inwardly therefrom. The lip 366 includes an upwardly tapering wall 368 and an upright wall 370, which is substantially parallel to the sidewall 322. The lip 366 along with an upper band 350 of the sidewall 322 form an upwardly opening channel 352 designed to receive a metal sealing ring 314. The upwardly tapering wall 368 is formed at a steep enough angle to the horizontal to inhibit the accumulation of dried paint thereon.

An inner circumferential edge 336 of the sealing ring 314 is attached to the upright wall 370 in the same manner that the inner circumferential edge 236 of the embodiment shown in FIG. 3 is attached to the sidewall 222. Like the embodiment of FIG. 1, an outer circumferential edge 316 of the sealing ring 314 is crimped directly to the sidewall 322.

The bucket 312 is formed of polypropylene or high density polyethylene by a conventional solid phase pressure forming process. In accordance with this process, a sheet of plastic material is heated and the lip 366 of the bucket 312 is formed by compression. The sheet is then stretched into a mold by a heated ram and formed to its final shape, one which may be compatible with existing filling and handling equipment, by blowing the sheet against the mold. Inasmuch as ears (not shown) cannot be formed monolithically with the sidewall 322 when the bucket 312 is produced using such a process, the ears must be manufactured separately and then adhesively attached to the sidewall 322 at appropriate locations.

It will be understood by those skilled in the art that the above-described embodiments are meant to be merely exemplary and that they are susceptible of modification and variation without departing from the spirit and scope of the invention. For instance, the channels 152 and 352 of the embodiments shown in FIG. 2 and FIG. 4, respectively, can be formed by a Y-shaped upper rim of a plastic bucket. Therefore, the invention is not deemed to be limited except as defined in the appended claims.

I claim:

1. A container, comprising a plastic bucket having a closed bottom and an open top, said bucket including a sidewall, having a generally circular lateral cross-sectional shape, and a top rim formed as an annular upwardly opening channel having an inner circumferential wall and an outer circumferential wall connected at their lower ends to each other and said sidewall; and a double-tight metal sealing ring disposed in said channel and bridging said inner and outer circumferential walls thereof, an inner circumferential end of said sealing ring being hidden by said inner circumferential wall of said channel.

2. A container according to claim 1, wherein said inner circumferential wall of said channel is a straight continuous extension of said sidewall of said bucket, whereby said sealing ring is disposed radially outwardly of said sidewall so that said sidewall has a smooth continuous inner circumferential surface.

3. A container according to claim 1, wherein said sidewall of said bucket tapers from said top to said bottom, whereby the container can be nested within another such container.

4. A container according to claim 3, further comprising a lower annular rim depending from said bottom of said bucket as a straight continuous extension of said sidewall, said lower rim being dimensioned and located so as to releasably seat against an annular shoulder formed on a lid removably received in said sealing ring.

5. A container according to claim 1, wherein said outer circumferential wall of said channel is formed by a straight continuous extension of said sidewall of said bucket; and said inner wall of said channel projects upwardly and radially inwardly from said sidewall of said bucket.

6. A container according to claim 1, wherein said bucket is formed of polypropylene.

7. A container according to claim 1, wherein said bucket is formed of high density polyethylene.

8. A container according to claim 1, wherein at least one of said inner and outer circumferential walls of said channel is formed monolithically with said sidewall of said bucket.

9. A container according to claim 8, wherein said inner and outer walls of said channel are both formed monolithically with said sidewall of said bucket.

10. A container according to claim 1, wherein said inner circumferential end of said sealing ring is embedded in said inner circumferential wall of said channel.

11. A container according to claim 10, wherein an inner circumferential edge of said sealing ring is crimped to said inner circumferential wall of said channel.

12. A container according to claim 1, wherein an inner circumferential edge of said sealing ring is J-shaped in axial cross section, with the short leg of said J-shaped inner circumferential edge contacting a radially innermost circumferential surface of said inner circumferential wall of said channel, said inner circumferential end of said sealing ring being located at the terminus of said short leg.

13. A container according to claim 12, wherein said inner circumferential edge of said sealing ring is crimped to said inner circumferential wall of said channel.

14. A container according to claim 1, wherein inner and outer circumferential edges of said sealing ring are crimped to said inner and outer circumferential walls, respectively, of said channel.

15. A container according to claim 1, further comprising a plastic bottom wall formed monolithically with said sidewall of said bucket.

16. A container according to claim 5, further comprising an annular bead circumscribing a lower portion of the sidewall, the bead and the metal sealing ring having substantially equal outer diameters.

17. A paint can, comprising a plastic bucket including a bottom wall, a sidewall formed monolithically with said bottom wall and extending upwardly therefrom, said sidewall having a generally circumferential lateral cross-sectional shape, and a top rim formed monolithically with said sidewall as an annular upwardly opening channel having an inner circumferential wall and an outer circumferential wall connected at their lower ends to each other and said sidewall; and a double-tight metal sealing ring disposed in said channel bridging said inner and outer circumferential walls thereof, an inner circumferential end of said sealing ring being hidden by said inner circumferential wall of said channel to protect said inner circumferential end from corrosion and to prevent any corroded matter on said inner circumferential end from falling into the contents of said bucket.

18. A paint can according to claim 17, wherein said sidewall of said bucket and said inner circumferential wall of said channel form a smooth continuous surface to permit draining of paint back into said bucket and to prevent accumulation of dried paint under said sealing ring.

* * * * *